US012543806B2

(12) United States Patent
Picot

(10) Patent No.: US 12,543,806 B2
(45) **Date of Patent: *Feb. 10, 2026**

(54) CLOTHING CONFIGURATIONS WITH MULTIPLE RECLOSABLE ACCESS REGIONS

(71) Applicant: Bimla Picot, Southampton, NY (US)

(72) Inventor: Bimla Picot, Southampton, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/507,632

(22) Filed: Nov. 13, 2023

(65) Prior Publication Data

US 2024/0074522 A1 Mar. 7, 2024

Related U.S. Application Data

(60) Continuation of application No. 17/331,716, filed on May 27, 2021, now Pat. No. 11,812,797, which is a division of application No. 14/333,250, filed on Jul. 16, 2014, now Pat. No. 11,019,861.

(60) Provisional application No. 61/846,654, filed on Jul. 16, 2013.

(51) Int. Cl.

| | |
|---|---|
| ***A41D 13/12*** | (2006.01) |
| ***A41D 1/04*** | (2006.01) |
| ***A41D 1/06*** | (2006.01) |
| ***A41D 31/30*** | (2019.01) |
| ***D06N 3/00*** | (2006.01) |

(52) U.S. Cl.

CPC ..... *A41D 13/129* (2013.01); *A41D 13/1245* (2013.01); *D06N 3/0009* (2013.01); *D06N 3/0059* (2013.01); *A41D 1/04* (2013.01); *A41D 1/06* (2013.01); *A41D 13/1254* (2013.01); *A41D 31/30* (2019.02); *A41D 2300/322* (2013.01); *A41D 2400/44* (2013.01); *D06N 2209/1657* (2013.01); *D06N 2209/1671* (2013.01); *Y10T 442/2525* (2015.04)

(58) Field of Classification Search

None

See application file for complete search history.

(56) References Cited

U.S. PATENT DOCUMENTS

| | | | |
|---|---|---|---|
| 1,489,046 | A | 4/1924 | Thompson |
| 1,641,487 | A | 9/1927 | Hockmeyer |
| 1,885,527 | A | 11/1932 | Arthur |
| 2,553,230 | A | 5/1951 | Albert |
| 3,276,036 | A | 10/1966 | Carter |
| 3,605,208 | A | 9/1971 | Charlile |
| 3,738,367 | A | 6/1973 | Hardy |
| 4,995,115 | A | 2/1991 | Ellis |

(Continued)

FOREIGN PATENT DOCUMENTS

| | | | |
|---|---|---|---|
| CA | 2777511 | A1 | 4/2011 |
| WO | WO2008089220 | A2 | 7/2008 |

*Primary Examiner* — Arti Singh-Pandey

(74) *Attorney, Agent, or Firm* — Dority & Manning, P.A.

(57) ABSTRACT

An article of clothing is provided having a plurality of accesses for accessing, when the clothing is worn by a wearer, the area below the clothing without removing the clothing. In one example, the article of clothing is an upper-body garment with two arm accesses, an anterior torso access, and two side torso accesses. In another example, the article of clothing is a lower-body garment with two leg accesses, two knee accesses, and two hip accesses. In one example, each access is opened or closed by an incremental fastening device such as a one-way or two-way zipper.

10 Claims, 14 Drawing Sheets

(56) References Cited

U.S. PATENT DOCUMENTS

| | | | | |
|---|---|---|---|---|
| 5,033,126 | A | 7/1991 | Wruck | |
| 5,097,535 | A | 3/1992 | Dye | |
| 5,553,323 | A | 9/1996 | Chou | |
| 5,564,123 | A | 10/1996 | Grassick | |
| 5,564,126 | A | 10/1996 | Chou | |
| 5,592,691 | A | 1/1997 | Ronald | |
| 5,717,999 | A | 2/1998 | Lurry | |
| 5,822,802 | A | 10/1998 | Chou | |
| 5,887,279 | A | 3/1999 | Elting et al. | |
| 6,647,552 | B1 * | 11/2003 | Hogan | A41D 13/1245 2/114 |
| 6,775,885 | B1 | 8/2004 | Wang | |
| 6,792,621 | B2 | 9/2004 | Braun | |
| D530,885 | S | 10/2006 | Barthel | |
| 7,934,269 | B1 | 5/2011 | Lask | |
| 8,161,573 | B1 | 4/2012 | Burns-Cox | |
| 11,812,797 | B2 * | 11/2023 | Picot | D06N 3/0009 |
| 2007/0199127 | A1 | 8/2007 | Coronado | |
| 2008/0092273 | A1 | 4/2008 | Marshall | |
| 2009/0031464 | A1 | 2/2009 | Luc | |
| 2010/0017933 | A1 | 1/2010 | Taylor-Barry | |
| 2011/0302690 | A1 | 12/2011 | Cox | |
| 2012/0017348 | A1 | 1/2012 | Ellsworth | |
| 2012/0030851 | A1 | 2/2012 | Kinder | |
| 2012/0096622 | A1 | 4/2012 | Johnson | |
| 2012/0117708 | A1 | 5/2012 | Trapani | |

* cited by examiner

CLOTHING CONFIGURATIONS WITH MULTIPLE RECLOSABLE ACCESS REGIONS

RELATED APPLICATIONS

The present application is a continuation application and is based upon and claims priority to U.S. patent application Ser. No. 17/331,716, having a filing date of May 27, 2021, which is a divisional application and claims priority to U.S. patent application Ser. No. 14/333,250, having a filing date of Jul. 16, 2014 now U.S. Pat. No. 11,019,861, and which claims priority to U.S. Provisional Application No. 61/846,654, filed on Jul. 16, 2013, all of which are incorporated herein by reference in their entirety.

BACKGROUND OF THE INVENTION

The present invention is a complete concept for dressing and undressing with clothing that is uniquely configured with panels and fasteners on the seams. Within each configuration of a garment, there is the possibility of accessing a multitude of body parts that are typically difficult to expose while wearing other clothing. The system also facilitates dressing and undressing for those with limited mobility. This concept and the clothing are invaluable for the encumbered, disabled, and elderly, as well as children and athletes.

It provides a system of clothing constructed to simultaneously provide easy access to and coverage of areas of the body that may require treatment by a medical professional or physical therapist. The system also allows for easier dressing of the disabled and/or the elderly by providing access to the patient's body via the clothing's system of panels and fasteners.

The present invention addresses the need for a conventional article of clothing that simultaneously provides coverage and access to the wearer's body. Conventional clothing articles, such as exercise-wear and the like, permit range of motion but do not address a need for access to body parts normally covered by conventional clothing.

SUMMARY OF THE INVENTION

The present invention is an improvement from current adaptive clothing configurations in that clothing of the present invention is constructed and arranged to facilitate dressing for the encumbered and impaired and to permit access to specific body parts via a system of panels and fasteners on the seams of the clothing. Thus, the present invention garments are practical for those required to wear medical devices such as casts, slings, and braces as well as for those who need easy access to wounds, surgical sites, port sites, and drains.

Additionally, the clothes expedite and facilitate access to most body parts, via one single garment (i.e., a top or bottom dress, robe, or gown), for treatment by medical providers and physical therapists while maintaining comfort and modesty for the patient.

Clothing, according to the present invention, is constructed to provide easy access for patients and healthcare providers for any one of wound care, access to picc lines, access to dialysis ports, access to central lines, access to arthroplasty sights, easy access for physicians and medical workers when doing body checks for skin cancer, especially in the elderly or encumbered, and all other situations in which it is advantageous to access below clothing without removing the clothing.

The present invention is also advantageous in each of the following situations: ease of dressing for patients who have internal/external fixation of a broken bone, ease of dressing for patients who wear ACL brace, ease of dressing for patients who have an Ilizarov apparatus, ease of access to wound sites in patients post-spinal surgery, ease of access to treatment sites for physical therapists, ease of access to ports for chemotherapy infusions, access to drains in post-surgical breast cancer patients, and individuals and caregivers can dress without disruption and discomfort to the wound site or medical apparatus.

The present invention is configured to be made to look as close to regular street wear and athletic wear as possible as opposed to the hospital sterile or utilitarian adaptive clothing that is currently on the market.

The present invention is a novel and technically enhanced solution to dress the encumbered, impaired, and disabled. The invention is a new way to construct clothing so that every seam can be opened and closed via a system of fasteners on the seams. This is a practical and improved system of easy-on, easy-off clothing that is comfortable, attractive, and affordable. The configuration is revolutionary in that clothing of the present invention is fashionable and one garment serves a multitude of rehabilitation needs.

Research has shown a direct correlation between one's psychological state of mind and the rapidity and success in healing. A positive self-image can lead to a faster recovery from surgery/illness and expedites the healing process. Those who see themselves "on the road to recovery" achieve successes more quickly than those who think of themselves as patients or disabled. Given the correlation between one's state of mind and the rapidity of recovery, the invention's system of clothing creates and enhances a sense of wellness in the wearer. The invention is a system of constructing clothing that is highly functional and stylish. The clothing looks good and feels good, thus helping patients to rebound quickly to their daily routines.

The clothing is available in antimicrobial fabrics to reduce the risk of infection at the wound site, a major concern for post-operative patients and those with weak immune systems or flesh injuries.

This system of clothing construction or engineering facilitates and expedites access by medical workers to affected body parts. The systems make it easier for individuals to get dressed or be dressed all while maintaining an individual's dignity.

Additionally, the clothing is configured to accommodate those who are wearing orthopedic devices. In one embodiment, the invention has a fastening system on the seams of the arm sleeves and pant legs to keep the clothing in place over a cast, a brace, or other medical device, thus eliminating the need to cut open conventional clothing or wrap ill-fitted conventional garments around or over the appendage with the device.

The invention is configured with a system of panels and fasteners. An individual can slip a panel under or around an affected area without having to move the appendage, thus "dressing around" the injury. In the case of devices and braces where the apparatus is too large to accommodate a closed leg, the pants unzip at the knee to accommodate the apparatus while rendering the other leg covered with a full pant leg. In the case of devices and braces where the apparatus is too large to accommodate a closed sleeve, the sleeve unzips from the collar or from the sleeve opening distal to the collar to accommodate the apparatus while rendering the other arm covered with a full sleeve. This feature is particularly useful for those with internal/external fixation devices used to immobilize the fractured appendage. Those devices immobilize the appendage and cannot be taken on and off. It is nearly impossible to dress and undress with conventional clothing while fitted with internal/external fixation devices.

The knee zippers also function to render the pants into exercise shorts. The lower pant leg can be zipped back on after a physical therapy or gym session to provide warmth and protection to the wearer once they leave the clinic. The ability of the pants to be converted into shorts also makes the clothing attractive and very useful for those who are without medical conditions but who prefer to wear shorts while exercising but pants for the rest of the day. Such dynamic aspects of the clothing and its fashion-forward design make the clothing ideal for anyone.

In one embodiment, a two-way zipper system and/or any other type of openable and closable fastener on the seam allows for easy enclosure of extremities during dressing, thus eliminating pain and anxiety by avoiding disruption of the afflicted area. In this regard, the clothing is particularly useful for the elderly, who are fragile and who experience pain with the slightest movement of body parts. The clothing panels can be easily slipped under and around the individual and then fastened. The wearer no longer needs to struggle to put arms through sleeves, legs through pants, or the head through a neck opening. The wearer need not even be upright to dress. In the example of a chronic-care patient, the clothing can be slid under and around the patient without him/her having to be moved from the bed.

In another embodiment, the clothing of the present invention is used during a range of treatments via panels and fasteners on the seams of the clothing. Thus, it is practical for patients wearing casts, slings, and braces as well as for individuals needing easy access to ports and drains. Additionally, the clothes allow access to most body parts. The system of panels that can be opened and closed at either side of a seam enables expedited treatment by medical professionals and physical therapists while ensuring comfort and modesty for the patient. The medical worker can easily access the wound site by simply opening the portion of the panel that is covering the wound, thus eliminating the need for the patient to undress completely for the examination. This feature saves the patient from unnecessary pain and the anxiety of disturbing the affected area. It allows the patient to maintain modesty and dignity while simultaneously enabling the medical worker to more efficiently treat the patient by providing them with direct access to the wound site without the obstruction of fabric from a hospital gown.

The present invention encompasses sporty, fashion-forward tops and bottoms for both men and women. The pieces are made to look as close to regular street wear as possible as opposed to the hospital sterile or utilitarian clothing that is currently on the market. The athletic nature of the garments is particularly useful in physical therapy sessions during a patient's rehabilitation. The fabric is stretchy allowing for ease of movement and enhanced mobility. The athletic style of the garments conveys a sense of activity, mobility, and fitness as opposed to the experience one has in physical therapy while sporting a hospital gown.

The present invention is configured as a "one garment fits all" solution to dress the impaired. The present invention provides a practical system of easy-on, easy-off clothing that is comfortable, attractive, and affordable.

In general, the present disclosure is directed to an article of clothing with a plurality of accesses for accessing the area below the clothing when worn by a wearer. The disclosed article of clothing is generally an upper-body garment and/or a lower-body garment.

The disclosed upper-body garment generally comprises a torso portion, wherein the superior end of the torso portion is proximal to a collar and two sleeves, and wherein the inferior edge of the torso portion includes at least one hem. The torso portion is generally understood to comprise a front, a back, and two sides.

The disclosed upper-body garment comprises one or more accesses, which can include, for instance, one or more arm accesses, one or more anterior torso accesses, and/or one or more side torso accesses. In one embodiment, the upper-body garment comprises at least one arm access that extends from the collar to the edge of the sleeve opening distal to the collar. An arm access can comprise, for example, a 2-way separating zipper. In one embodiment, the upper-body garment comprises at least one anterior torso access that extends along the front of the torso portion from the collar to the hem. An anterior torso access can comprise, for example, a 1-way separating zipper. In one embodiment, the upper-body garment comprises at least one side torso access that extends along the side of the torso portion from the hem to a region of the torso portion superior to the hem. A side torso access can comprise, for example, a 2-way open zipper.

The disclosed lower-body garment generally comprises two leg portions, wherein the superior end of the leg portions is proximal to a waistline, and wherein the inferior edge of each leg portion includes at least one hem.

The disclosed lower-body garment comprises one or more accesses, which can include, for instance, one or more leg accesses, one or more knee accesses, and/or one or more hip accesses. In one embodiment, the lower-body garment comprises at least one leg access that extends along the leg portion from the hem to a region of the leg portion superior to the hem. A leg access can comprise, for example, a 1-way open zipper. In one embodiment, the lower-body garment comprises at least one knee access that extends radially about the leg portion. A knee access can comprise, for example, a 2-way separating zipper. In one embodiment, the lower-body garment comprises a hip-access that extends along the side of the lower-body garment from the waistline to a region of the leg portion inferior to the waistline. A hip access can comprise, for example, a 2-way open zipper.

In one embodiment, at least one of the accesses of the upper-body garment or lower-body garment is opened or closed by an incremental fastening device. In one embodiment, at least one of the accesses of the upper-body garment or lower-body garment is concealed or is not readily noticeable.

In one embodiment, the article of clothing comprises a knit fabric. In one embodiment, the article of clothing comprises a fabric that contains at least 90% polyester. In one embodiment, the article of clothing comprises antimicrobial fabric.

These and other features and aspects of the present disclosure are discussed in greater detail below.

BRIEF DESCRIPTION OF THE DRAWINGS

A full and enabling disclosure of the present invention is set forth more particularly in the remainder of the specification, including reference to the appended figures in which.

Figure 1:
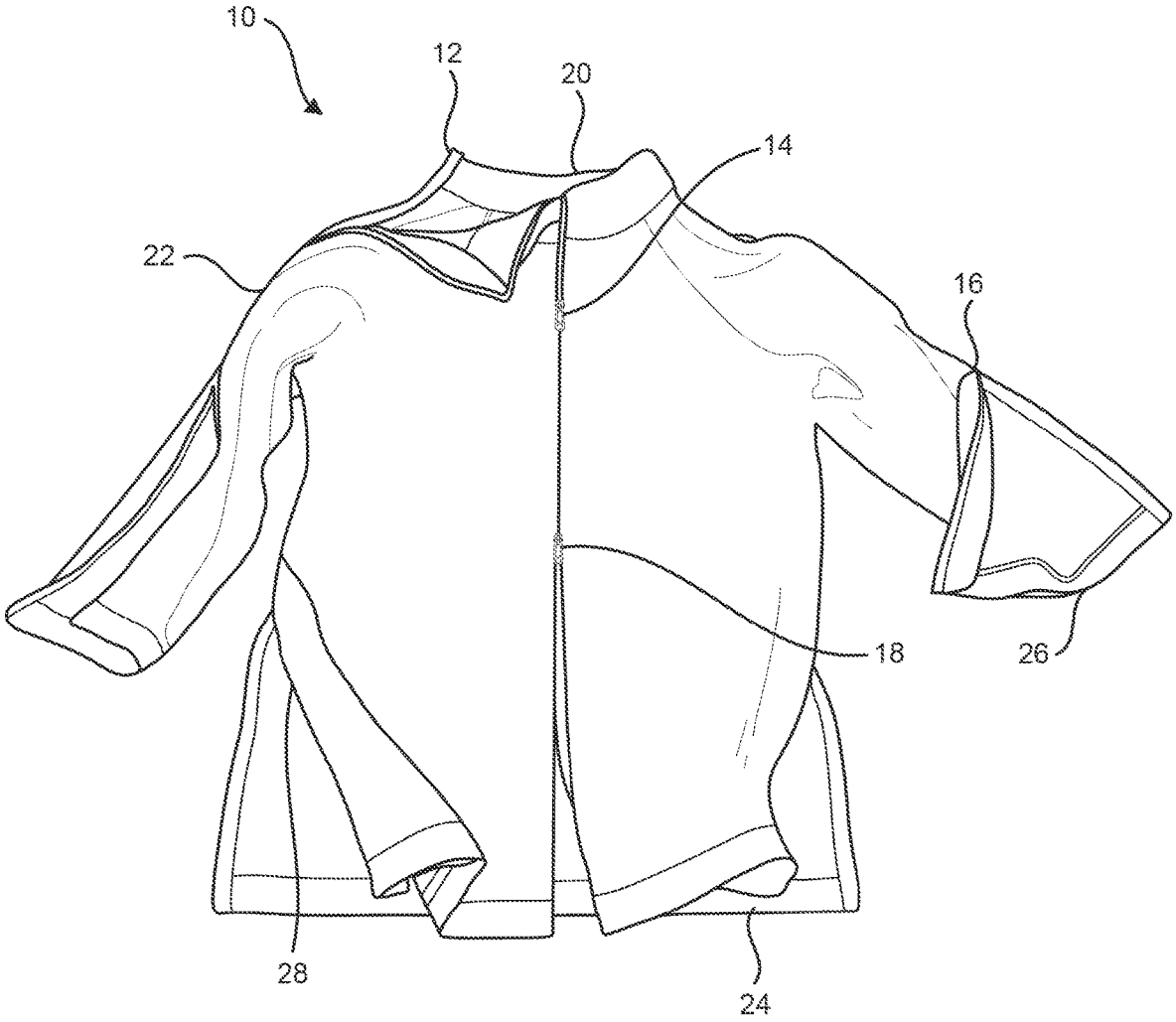
FIG. 1 is a frontal plan view of one embodiment of an upper-body garment configured according to the present invention.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to an article of clothing comprising a plurality of accesses for accessing the area below the clothing when the clothing is worn by a wearer. The present invention relates to articles of clothing that provide multiple adjustable and reclosable accesses beneath the article of clothing. Unlike conventional hospital gowns, conventional exercise wear, street wear, and medical clothing, the articles configured according to the present invention allow for a user to remain substantially clothed while providing selective access to desired regions. In one embodiment, the article of clothing can be an upper-body garment. In another embodiment, the article of clothing can be a lower-body garment.

The upper-body garment generally comprises a torso portion, wherein the superior end of the torso portion is proximal to a collar and two sleeves. A sleeve of the upper-body garment can be a short sleeve, a long sleeve, or a sleeve of some length greater than the length of a short sleeve but shorter than the length of a long sleeve. The inferior edge of the torso portion can comprise at least one hem. The torso portion is generally understood to comprise a front, a back, and two sides. The upper-body garment comprises one or more accesses, which can include, for instance, one or more arm accesses, one or more anterior torso accesses, and/or one or more side torso accesses.

As will be explained below, the one or more accesses of the upper-body garment are, for example, useful for allowing access below the upper-body garment when the upper-body garment is worn by a user required to wear one or more medical devices, such as casts, slings, braces, and splints, and/or for accommodating such medical devices.

Figure 9A:
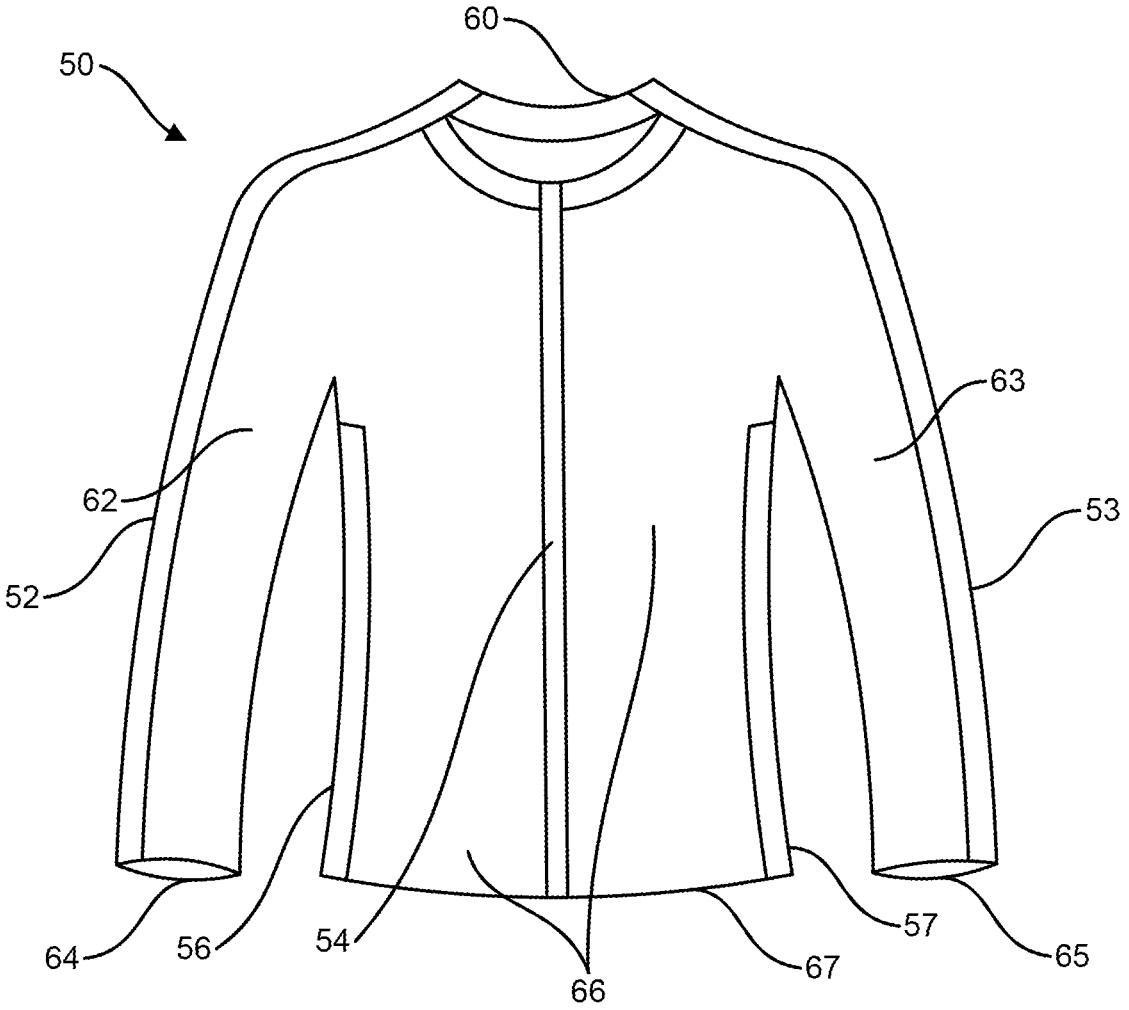
FIG. 9A is a frontal plane view of another embodiment of an upper-body garment configured according to the present invention.
Figure 9B:
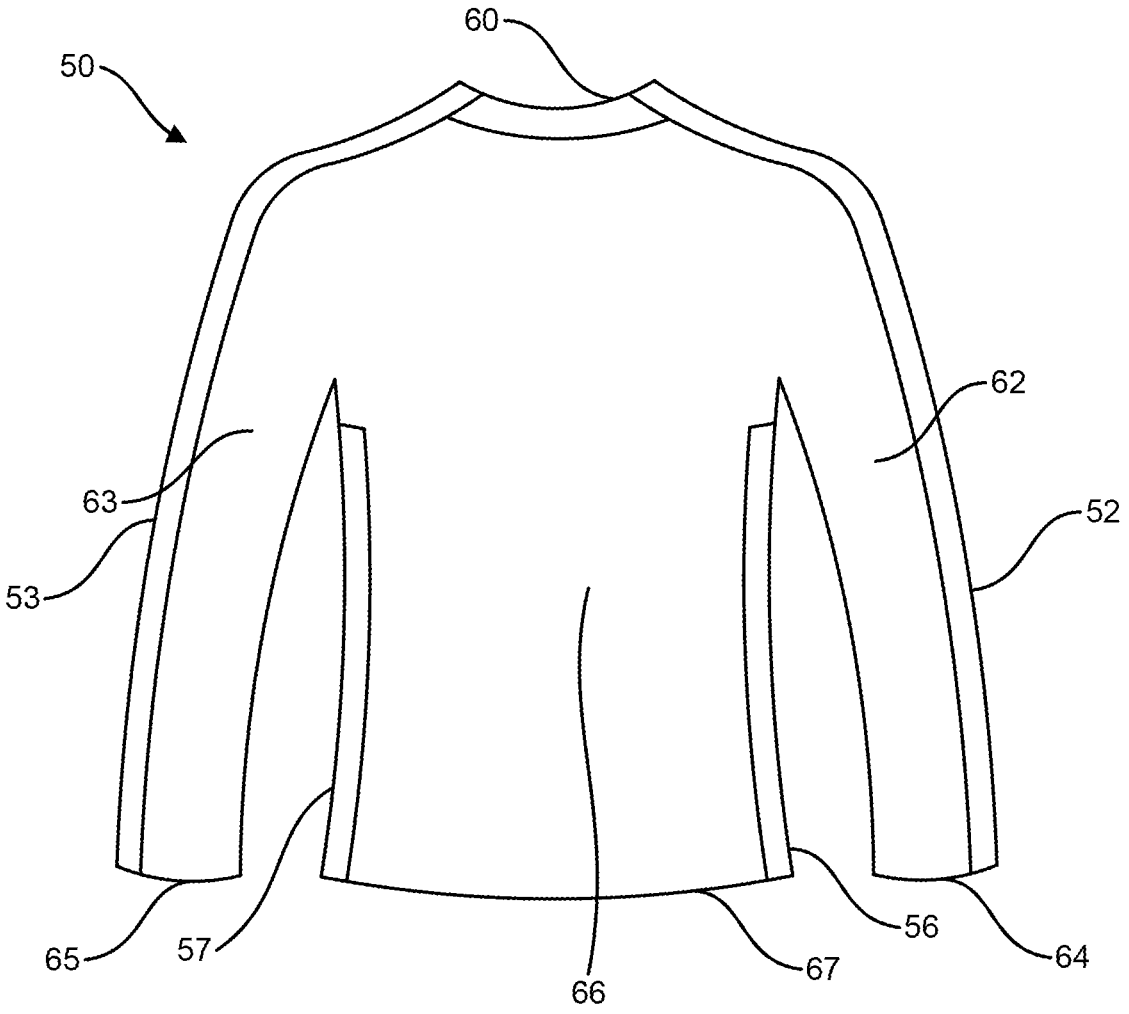
FIG. 9B is a rear plane view of the upper-body garment from FIG. 9A.

Referring to FIGS. 9A and 9B, upper-body garment 50 demonstrates one embodiment of the present invention. Upper-body garment 50 comprises torso portion 66, hem 67, collar 60, sleeve 62, the edge 64 of the opening of sleeve 62 distal to collar 60, sleeve 63, and the edge 65 of the opening of sleeve 63 distal to collar 60. Sleeve 62 and sleeve 63 are shown to be long sleeves, but sleeve 62 and/or sleeve 63 can comprise sleeves of any length, such as short sleeves, long sleeves, or three-quarters length sleeves. FIG. 9A shows the front of upper-body garment 50, including the front of torso portion 66 and the front of the sides of torso portion 66. FIG. 9B shows the back of upper-body garment 50, including the back of torso portion 66 and the back of the sides of torso portion 66.

In one embodiment, the upper-body garment can be modified to look like every-day wear. For example, collar 60 of upper-body garment 50 can comprise a crew neck collar, V-neck collar, high-neck collar, turnover collar, flat collar, stand-up collar, or other type of collar. Also, for example, upper-body garment 50 can resemble a button-up shirt or blouse by, for instance, comprising a row of buttons along the front of torso portion 66. Also, for example, upper-body garment 50 can resemble a polo shirt by, for instance, comprising a placket at collar 60. Also, for example, upper-body garment 50 can resemble a hospital gown. Also, for example, upper-body garment 50 can resemble a pajama shirt.

In one embodiment, the upper-body garment comprises at least one arm access. An arm access is configured along some length of a sleeve and is constructed and arranged such that the arm access provides access to a wearer's neck, shoulder, upper arm, elbow, forearm, wrist and/or etc. without requiring the wearer to remove the upper-body garment. For example, an arm access can extend from the collar to the edge of the sleeve opening distal to the collar. Alternatively, an arm access can extend from the collar to a region of the sleeve that is distal to the collar but not at the edge of the sleeve opening distal to the collar. Alternatively, an arm access can extend from the edge of a sleeve opening distal to the collar to a region of the sleeve that is distal to said edge but not at the collar.

In one embodiment, the upper-body garment comprises one arm access along each sleeve. In another embodiment, the upper-body garment comprises more than one arm access along at least one sleeve. In another embodiment, the upper-body garment comprises one or more arm accesses along a first sleeve and no arm accesses along a second sleeve.

Upper-body garment 50 comprises a first arm access 52 that extends along sleeve 62 from collar 60 to the edge 64 of the opening of sleeve 62 distal to collar 60. Upper-body garment 50 also comprises a second arm access 53 that extends along sleeve 63 from collar 60 to the edge 65 of the opening of sleeve 63 distal to collar 60.

In one embodiment, the article of clothing is comprised of at least one access that is opened or closed by an incremental fastening device. As used herein, an incremental fastening device is to be distinguished from an assembly of separate devices such as buttons or snaps. An incremental fastening device can comprise, for example, a zipper, a hook and loop type fastener, a sliding clasp fastener, a zip-lock fastener, or a sealing tape.

Figure 11A:
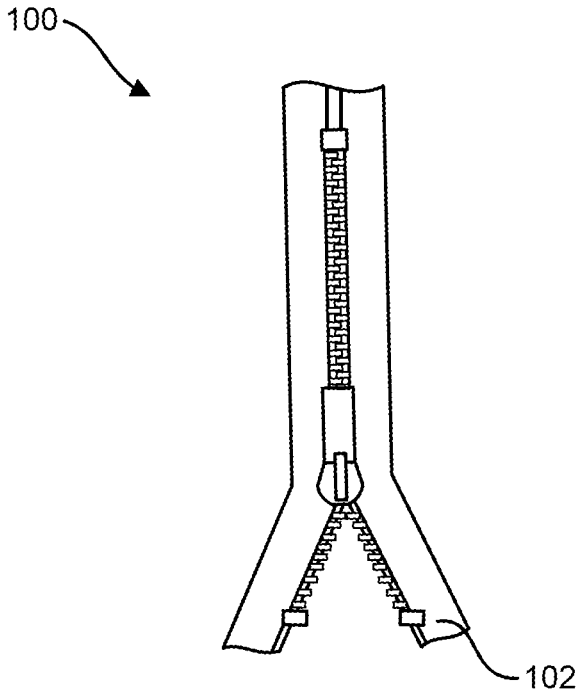
FIG. 11A is a perspective view of a 1-way open zipper.
Figure 11B:
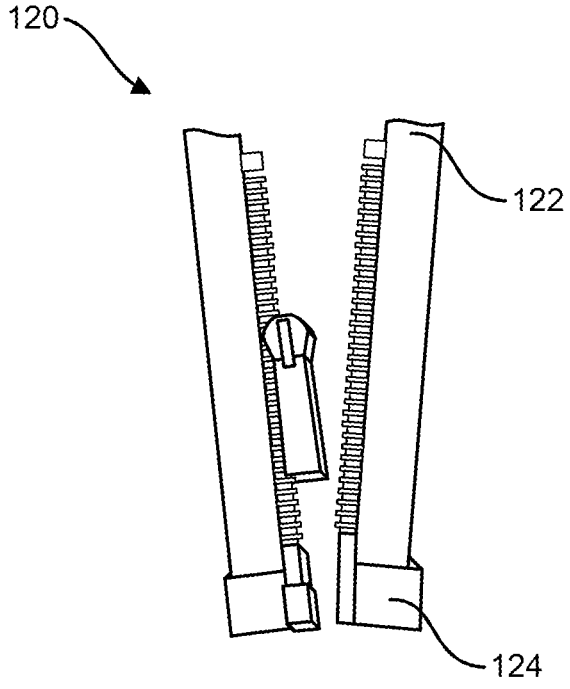
FIG. 11B is a perspective view of a 1-way separating zipper.

In one embodiment, for example, the incremental fastening device comprises a 1-way zipper. Referring to FIGS. 11A and 11B, the 1-way zipper can be a 1-way open zipper 100 or a 1-way separating zipper 120. In FIG. 11A, 1-way open zipper 100 opens and closes at end 102. In FIG. 11B, 1-way separating zipper 120 opens and closes at end 122 and separates at end 124.

Figure 2:
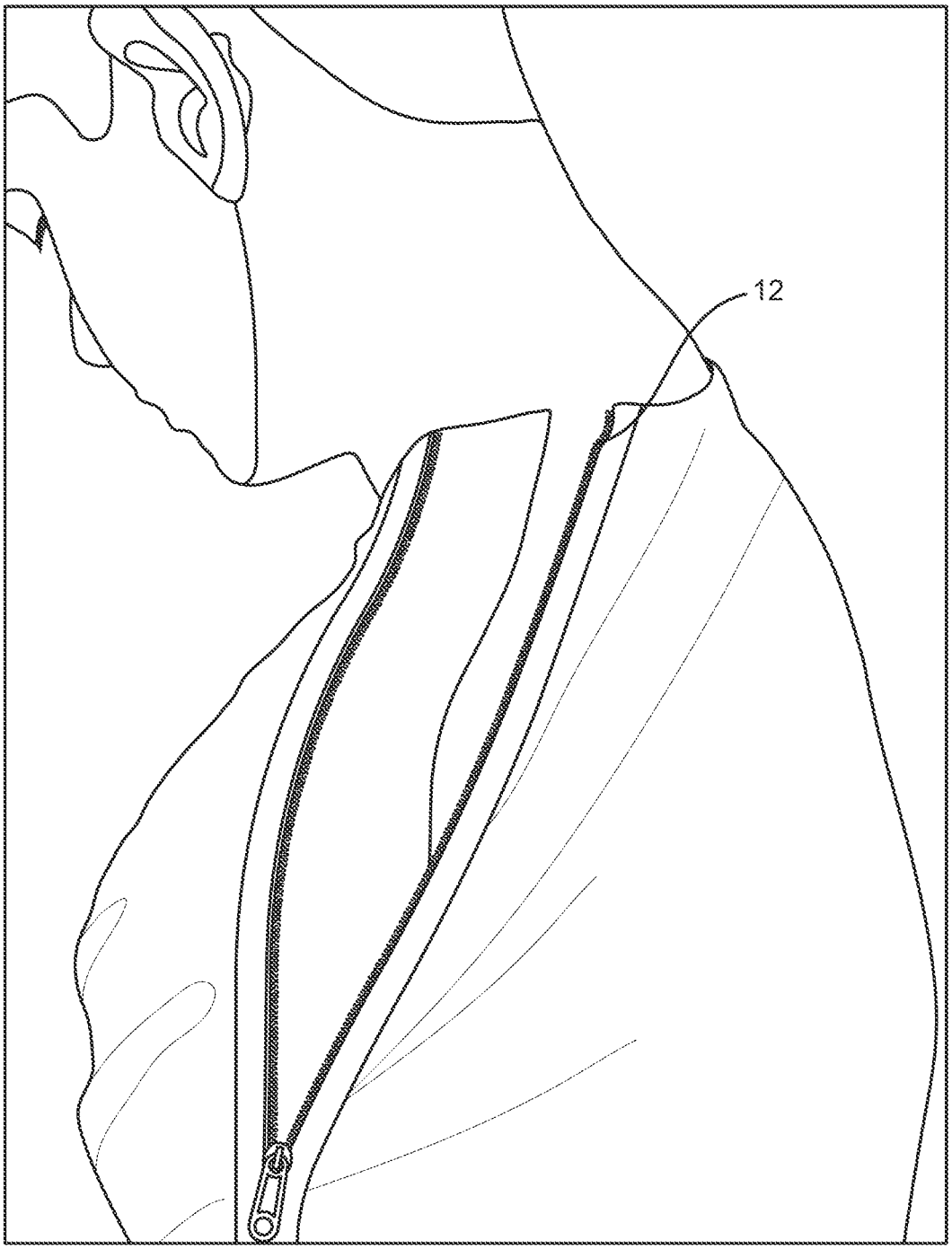
FIG. 2 is a close-up perspective view of an arm access of the upper-body garment from FIG. 1.
Figure 12A:
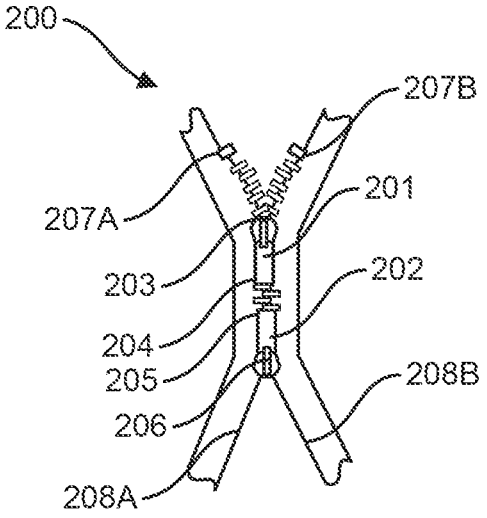
FIG. 12A is a perspective view of a 2-way open zipper.
Figure 12B:
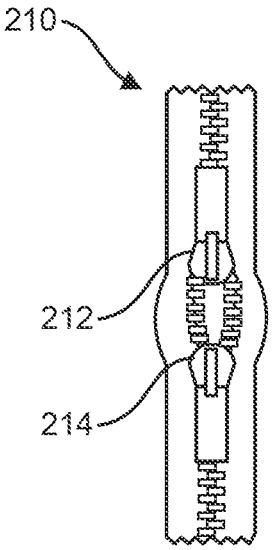
FIG. 12B is a perspective view of a 2-way O-type zipper.
Figure 12C:
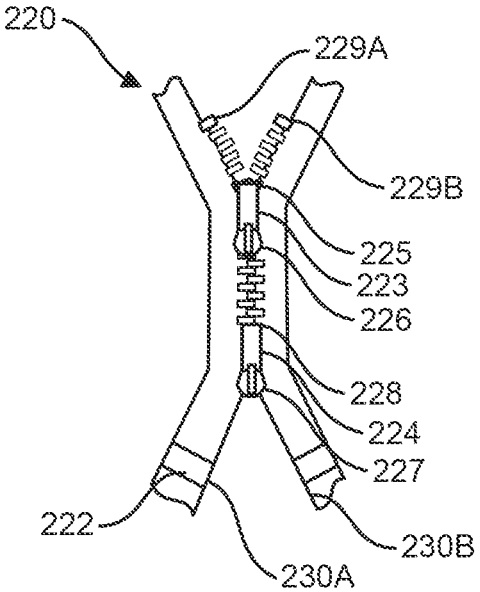
FIG. 12C is a perspective view of a 2-way separating zipper.

In another embodiment, for example, the incremental fastening device comprises a 2-way zipper. Referring to FIGS. 12A, 12B, and 12C, the 2-way zipper can be a 2-way open zipper 200, a 2-way O-type zipper 210, or a 2-way separating zipper 220. In FIG. 12A, 2-way open zipper 200 opens and closes at both ends of the zipper. In FIG. 12B, 2-way O-type zipper 210 does not open or close at the ends of the zipper but rather opens and closes between slider 212 and slider 214. In FIG. 12C, 2-way separating zipper 220 opens and closes at both ends of the zipper and separates at end 222.

In one embodiment, an arm access is opened or closed by an incremental fastening device. For example, the arm access can comprise a 1-way separating zipper that can separate at the collar, a 1-way separating zipper that can separate at the edge of the sleeve opening distal to the collar, a 1-way open zipper that can open at the end of the arm access closest to the collar, or a 1-way open zipper that can open at the end of the arm access furthest from the collar. For example, first arm access 52 can comprise a 1-way separating zipper that separates at collar 60 or a 1-way separating zipper that separates at edge 64.

Also, the arm access can comprise, for example, a 2-way O-type zipper, a 2-way separating zipper that separates at the collar, a 2-way separating zipper that separates at the edge of the sleeve opening distal to the collar, or a 2-way open zipper that can open at both ends of the arm access. For example, first arm access 52 can comprise a 2-way separating zipper that separates at collar 60, a 2-way separating zipper that separates at edge 64, or a 2-way open zipper that opens at both collar 60 and edge 64.

In one embodiment, the upper-body garment comprises at least one anterior torso access. An anterior torso access is configured along some length of the front of the torso portion of the upper-body garment and is constructed and arranged such that the anterior torso access provides access to a wearer's neck, thorax, abdomen, pubic area, and/or etc. without requiring the wearer to remove the upper-body garment. For example, an anterior torso access can extend from the collar to the hem. Alternatively, an anterior torso access can extend from the collar to a region of the torso portion that is distal to the collar but not at the hem. Alternatively, an anterior torso access can extend from the hem to a region of the torso portion that is distal to the hem but not at the collar.

In one embodiment, the upper-body garment comprises only one anterior torso access along the front of the torso portion. In another embodiment, the upper-body garment comprises more than one anterior torso access along the front of the torso portion.

Upper-body garment 50 comprises anterior torso access 54 that extends along the front of torso portion 66 from collar 60 to hem 67.

In one embodiment, an anterior torso access is opened or closed by an incremental fastening device. For example, the anterior torso access can comprise a 1-way separating zipper that separates at the collar, a 1-way separating zipper that separates at the hem, a 1-way open zipper that can open at the end of the anterior torso access closest to the collar, or a 1-way open zipper that can open at the end of the anterior torso access closest to the hem. For example, anterior torso access 54 can comprise a 1-way separating zipper that separates at collar 60 or a 1-way separating zipper that separates at hem 67.

Also, the anterior torso access can comprise, for example, a 2-way O-type zipper, a 2-way separating zipper that can separate at the collar, a 2-way separating zipper that can separate at the hem, or a 2-way open zipper that can open at both ends of the anterior torso access. For example, anterior torso access 54 can comprise a 2-way separating zipper that separates at collar 60, a 2-way separating zipper that separates at hem 67, or a 2-way open zipper that opens at both collar 60 and hem 67.

In one embodiment, the upper-body garment comprises at least one side torso access. A side torso access is configured along some length of a side of the torso portion of the upper-body garment and is constructed and arranged such that the side torso access provides access to a wearer's axilla, lateral thorax, lateral abdomen, hip, and/or etc. without requiring the wearer to remove the upper-body garment. For example, a side torso access can extend from the hem to a region of the torso portion superior to the hem. Alternatively, a side torso access can extend from a region of the torso portion distal to the hem to a region of the torso portion proximal to the hem but not at the hem.

In one embodiment, the superior end of the side torso access is not located at or near the underarm or armpit region of the sleeve or torso portion of the upper-body garment. For example, the superior end of the side torso access can be located at least one-half inch away from the armpit region of the upper-body garment, such as at least one inch away, such as at least one and a half inches away, such as at least two inches away, such as least three inches away, such as at least six inches away, such as at least nine inches away, such as even at least twelve inches away, but no more than twenty-four inches away from the armpit region of the upper-body garment, such as no more than eighteen inches away, such as no more than twelve inches away, such as no more than nine inches away, such as no more than six inches away, such as no more than three inches away, such as no more than two inches away, such as no more than one and a half inch away.

The hem located at the inferior edge of the upper-body garment can be comprised of more than one section. For example, the hem may not be comprised of a single, continuous edge. Since both the anterior torso access and the side torso access can terminate at the hem, the hem can be separated into more than one section by, for example, the opening of either an anterior torso access terminating at the hem or a side torso access terminating at the hem.

In one embodiment, the upper-body garment comprises one side torso access along each side of the torso portion of the upper-body garment. In another embodiment, the upper-body garment comprises more than one side torso access along at least one side of the torso portion. In another embodiment, the upper-body garment comprises one or more side torso accesses along a first side of the torso portion and no side torso accesses along a second side of the torso portion.

Upper-body garment 50 comprises a first side torso access 56 that extends along the side of torso portion 66 that is closest to sleeve 62. First side torso access 56 extends from hem 67 to a region of torso portion 66 that is superior to hem 67. Upper-body garment 50 also comprises a second side torso access 57 that extends along the side of torso portion 66 that is closest to sleeve 63. Second side torso access 57 extends from hem 67 to a region of torso portion 66 that is superior to hem 67. Neither first side torso access 56 nor second side torso access 57 extend into the armpit region of upper-body garment 50.

In one embodiment, a side torso access is opened or closed by an incremental fastening device. For example, the side torso access can comprise a 1-way separating zipper that can separate at the hem or a 1-way open zipper that can open at the hem. For example, first side torso access 56 can comprise a 1-way separating zipper that separates at hem 67 or 1-way open zipper that opens at hem 67.

Also, the side torso access can comprise, for example, a 2-way O-type zipper, a 2-way separating zipper that can separate at the hem, or a 2-way open zipper that can open at both ends of the side torso access. For example, first side torso access 56 can comprise a 2-way separating zipper that separates at hem 67 or a 2-way open zipper that opens both at hem 67 and at the end of first side torso access 56 that is distal to hem 67.

Figure 3:
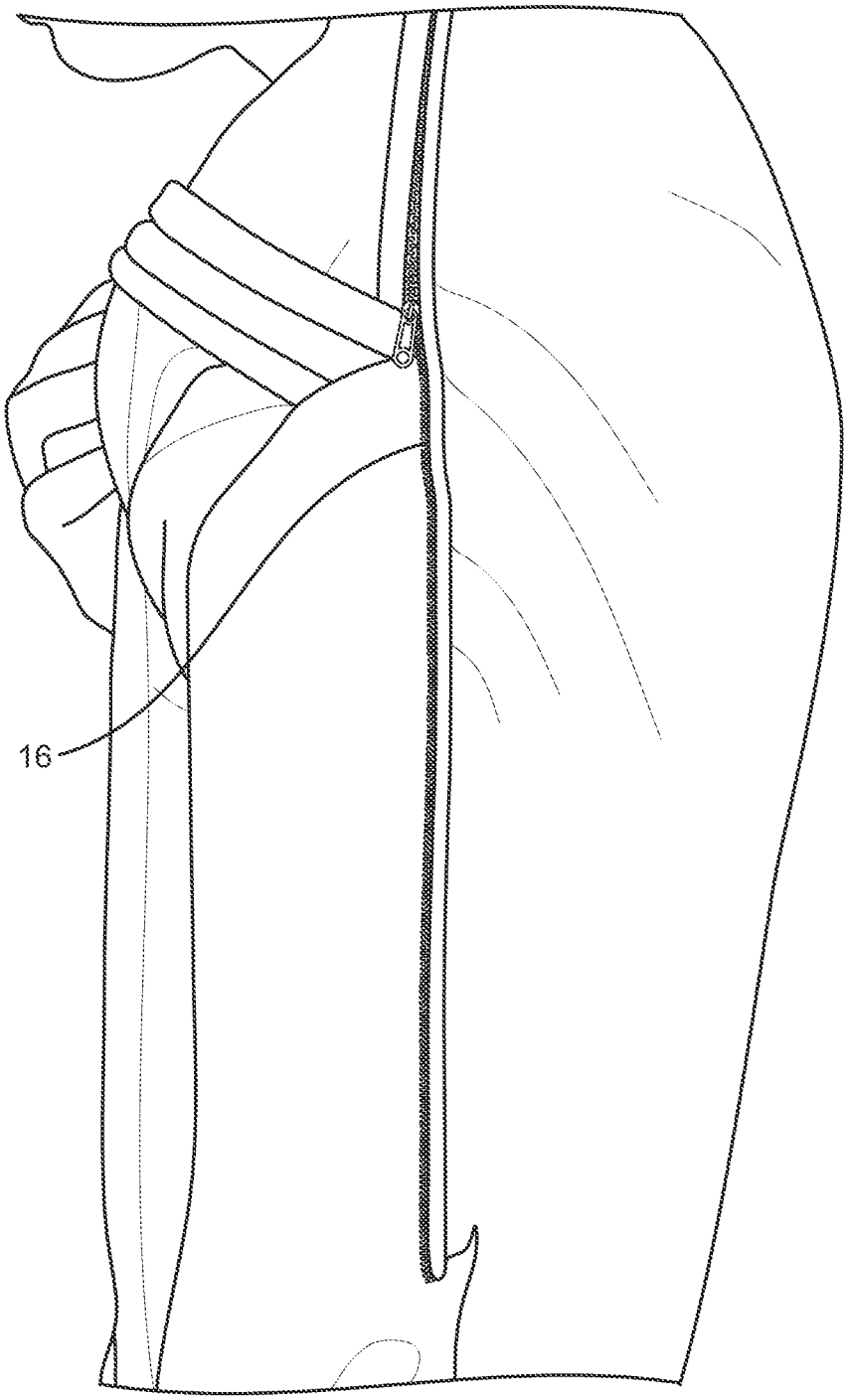
FIG. 3 is a close-up side view of an arm access of the upper-body garment from FIG. 1.

Referring to FIG. 1, shirt 10 demonstrates another embodiment of an upper-body garment configured according to the present invention. As demonstrated in FIGS. 1 through 3, shirt 10 has a first arm access 12 and a second arm access 16 configured along the length of shirt sleeve 22. First arm access 12 extends up into the collar area 20 of shirt 10. Second arm access 16 extends downward to the wrist region 26 of sleeve 22. Specifically, second arm access 16 extends to the edge of the opening of sleeve 22 distal to collar area 20. As can be seen in FIG. 2, first arm access 12 is constructed and arranged such that the shoulder and upper arm portion is accessible outside of shirt 10 without the need to remove shirt 10. As can be seen in FIG. 3, second arm access 16 becomes equally accessible to expose a portion up into and including a majority of the arm of a wearer.

In this embodiment, first arm access 12 is considered to be an access created by the slider of the 2-way zipper along sleeve 22 that is proximal to collar area 20 and the second arm access 16 is considered to be the access created by the slider of the 2-way zipper along sleeve 22 that is distal to collar area 20. However, together, first arm access 12 and second arm access 16 can be considered to form a single arm access along sleeve 22. This single arm access comprises a 2-way zipper that, for example, can be a 2-way open zipper, a 2-way separating zipper that separates at collar area 20, or a 2-way separating zipper that separates at wrist region 26.

The shirt further is configured to have first anterior torso access 14 and second anterior torso access 18 configured along the front of shirt 10. First anterior torso access 14 extends upward and terminates at collar 20. Second anterior torso access 18 extends downward and terminates along shirt hem 24. Together, first anterior torso access 14 and second anterior torso access 18 can be considered to form a single anterior torso access along the front of shirt 10. This single anterior torso access comprises a 2-way zipper that, for example, can be a 2-way open zipper, a 2-way separating zipper that separates at collar area 20, or a 2-way separating zipper that separates at shirt hem 24.

Figure 4:
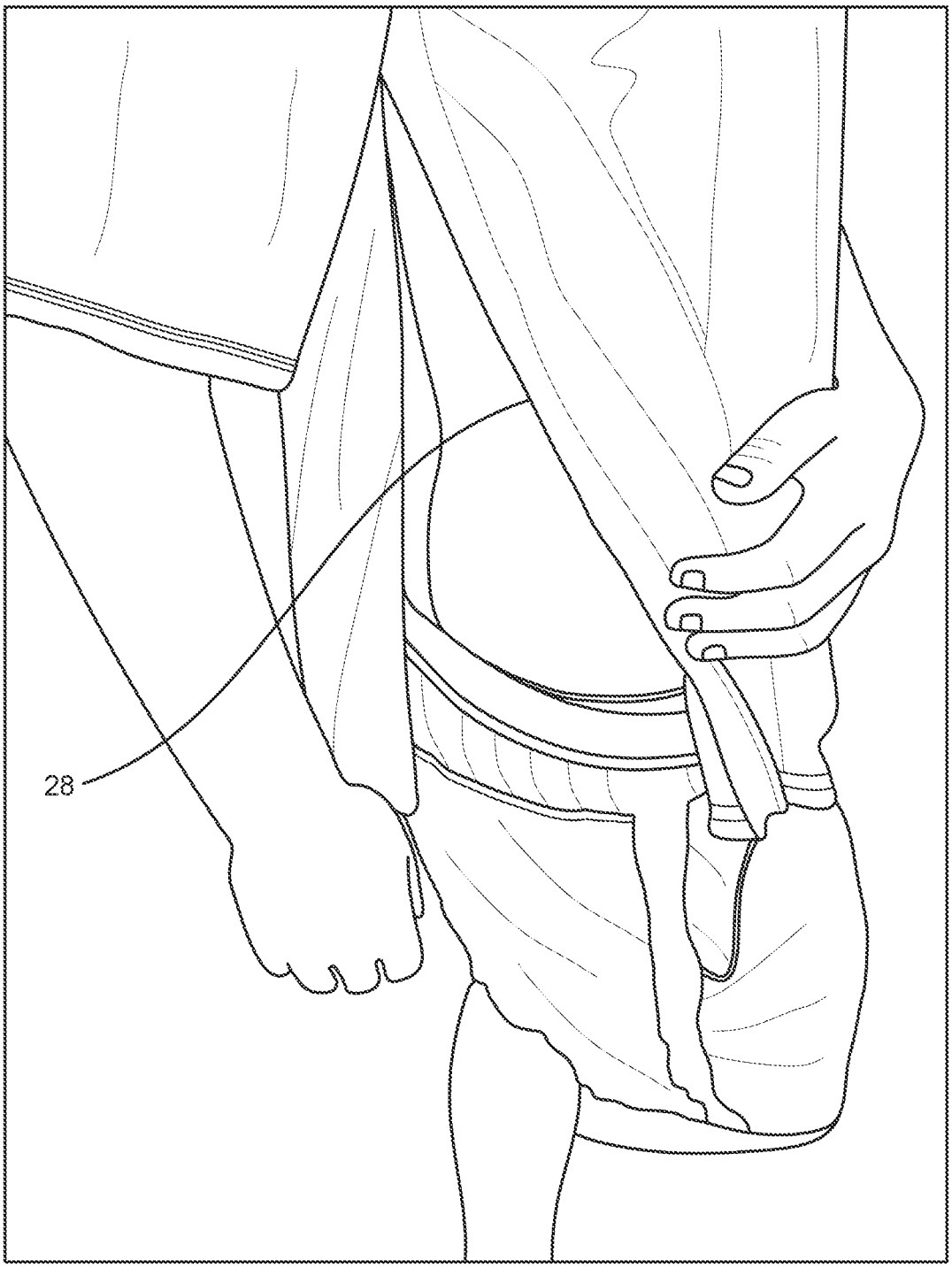
FIG. 4 is a close-up side view of a side torso access of the upper-body garment from FIG. 1.

Shirt 10 is further constructed and arranged with side torso access 28 configured as opposing access means on both sides of shirt 10. Side torso access 28 extends from shirt hem 24 to a region of shirt 10 superior to shirt hem 24. As can be seen in FIG. 4, side torso access 28 is constructed and arranged such that it provides access to a wearer's hip, lateral abdomen, and lateral thorax.

Shirt hem 24 is comprised of three separate sections since side torso access 28 terminates at shirt hem 24 on both sides of shirt 10 and second anterior torso access 18 terminates at shirt hem 24 in the front of shirt 10.

In one non-limiting example, a user wearing shirt 10 of the present invention in need of access to one or more specific regions, will open any one or more of the access openings and be provided with access underneath shirt 10. For example, if access is needed to a forearm in order to administer or maintain an intravenous port, second arm access 16 provides access to the forearm of a user.

Although demonstrated that each access of shirt 10 is configured as a zipper, it is contemplated that any reclosable means can be incorporated into shirt 10. Additionally, it is contemplated in one embodiment that shirt 10 can be constructed and arranged with different types of reclosable access means.

The present invention also contemplates configuration as a pair of pants. The lower-body garment contemplated by this invention generally comprises two leg portions, wherein the superior end of the leg portions is proximal to a waistline. The inferior edge of each leg portion can comprise at least one hem. The lower-body garment comprises one or more accesses, which can include, for instance, one or more leg accesses, one or more knee accesses, and/or one or more hip accesses.

Figure 10A:
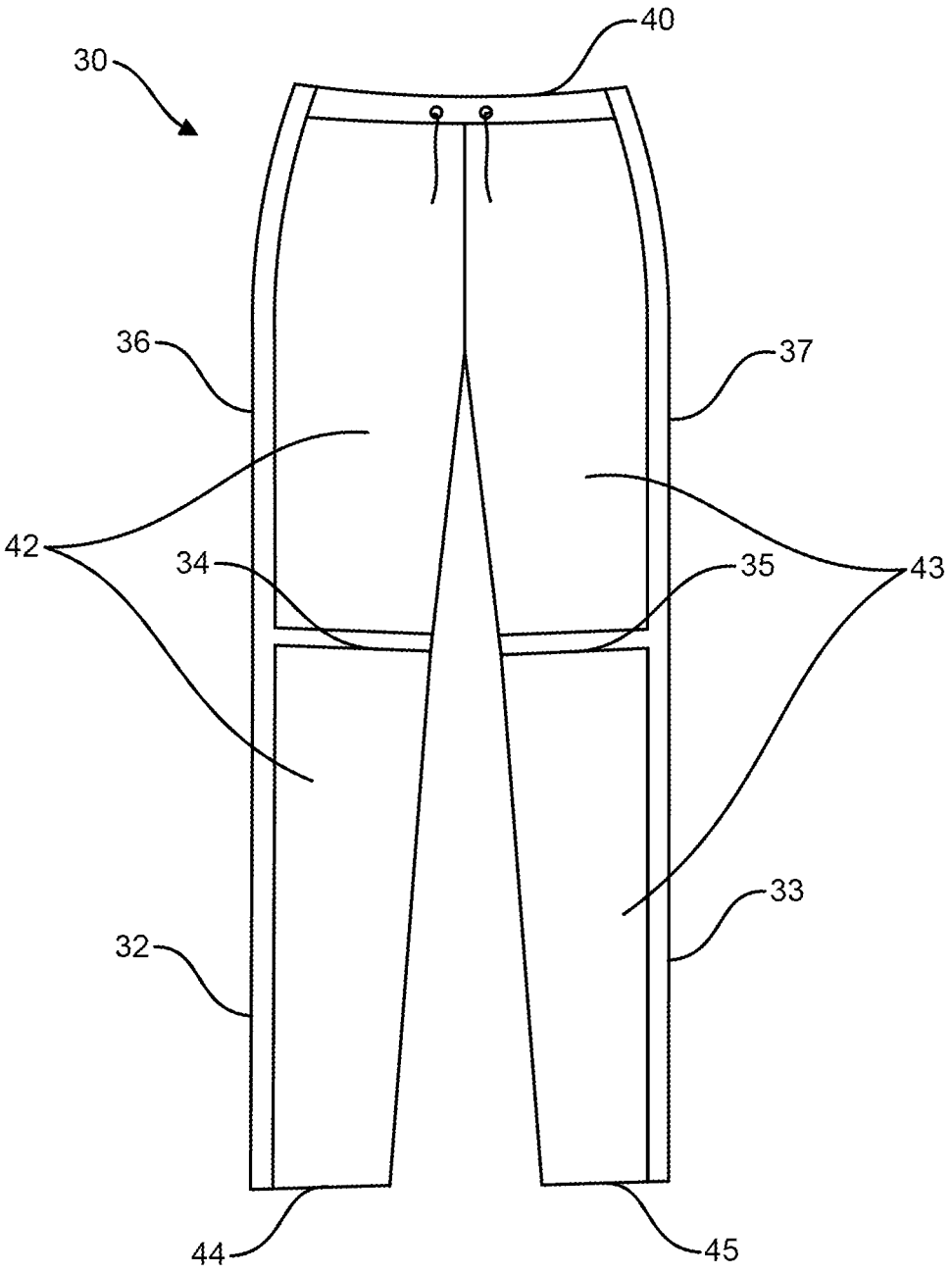
FIG. 10A is a frontal plane view of another embodiment of a lower-body garment configured according to the present invention.
Figure 10B:
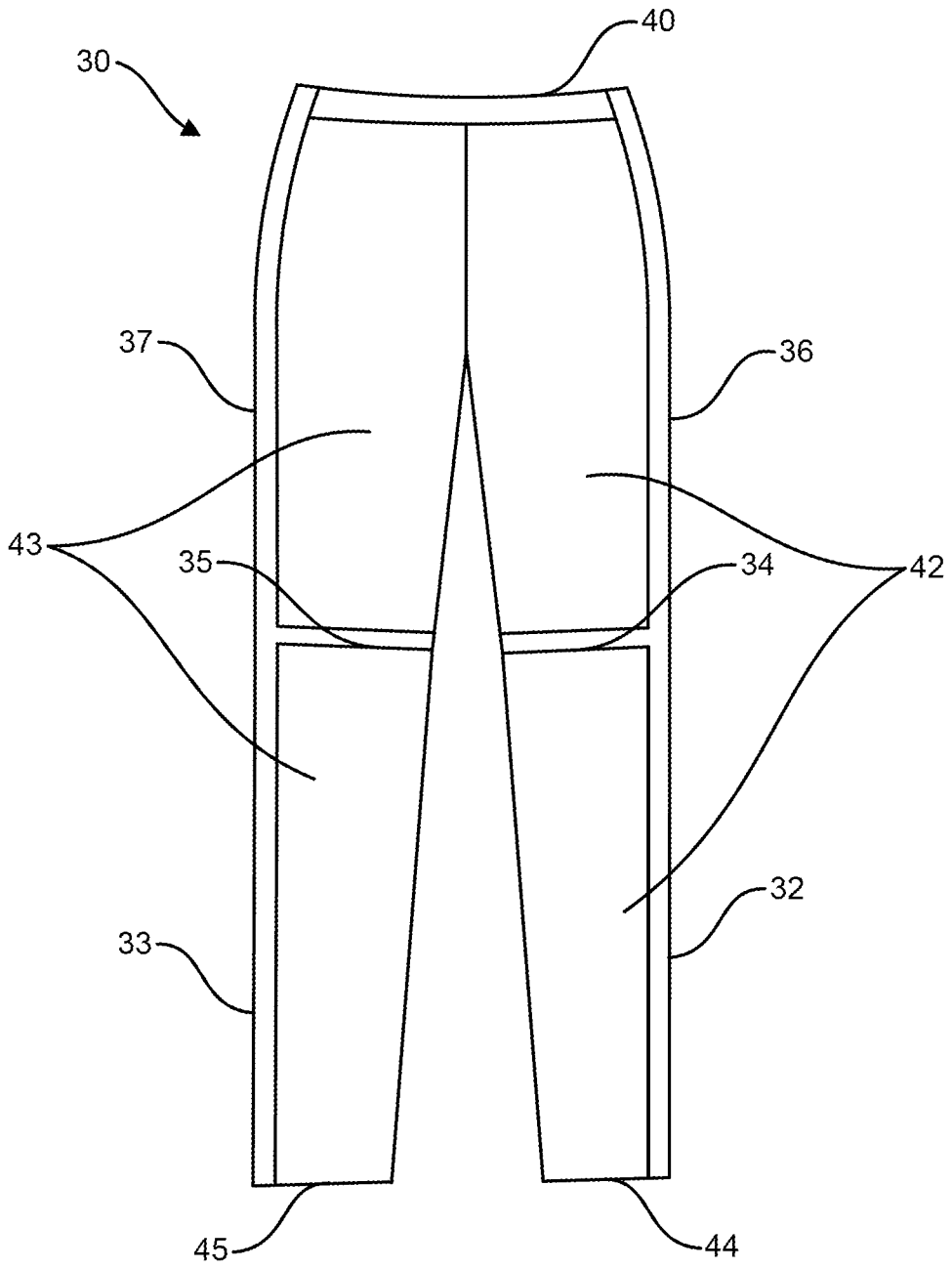
FIG. 10B is a rear plane view of the lower-body garment from FIG. 10A.

Referring to FIGS. 10A and 10B, pants 30 demonstrate one embodiment of a lower-body garment configured according to the present invention. Pants 30 comprise waistline 40, leg portion 42, hem 44 at the inferior edge of leg portion 42, leg portion 43, and hem 45 at the inferior edge of leg portion 43. FIG. 10A shows the front of pants 30. FIG. 10B shows the back of pants 30.

In one embodiment, the lower-body garment can be modified to look like every-day wear. For example, pants 30 can comprise a permanent press fabric and/or one or more creases. Also, for example, pants 30 can comprise a fly opening extending down from waistline 40. Also, for example, pants 30 can comprise pleats at waistline 40. Also, for example, pants 30 can comprise belt loops at waistline 40. Also, for example, pants 30 can comprise elastic and/or one or more drawstrings about waistline 40. Also, for example, pants 30 can resemble pajama pants and can match an upper-body garment made according to the present invention that resembles a pajama shirt.

In one embodiment, the lower-body garment comprises at least one leg access. A leg access is configured along some length of a leg portion of the lower-body garment and is constructed and arranged such that the leg access provides access to a wearer's foot, ankle, lower leg, knee, upper leg, hip, and/or etc. without requiring the wearer to remove the lower-body garment. For example, a leg access can extend from the hem to a region of the leg portion that is superior to the hem. Alternatively, a leg access can extend from a region of the leg portion distal to the hem to a region of the leg portion proximal to the hem but not at the hem.

The hem located at the inferior edge of a leg portion of the lower-body garment can be comprised of more than one section. For example, the hem may not be comprised of a single, continuous edge. Since the leg access can terminate at the hem, the hem can be separated into more than one section by, for example, the opening of two leg accesses terminating at the hem of a single leg portion of the lower-body garment.

In one embodiment, a leg access extends from the hem to the waistline.

In one embodiment, a leg access extends from the hem to a region of the leg portion that is, when the lower-body garment is worn by a wearer, superior to the wearer's knee. For example, the leg access can extend from the hem to a region of the leg portion that is superior to the hem and distanced from the hem by at least 40% of the length of the hem to the waistline, such as at least 45%, such as at least 50%, such as at least 55%, such as at least 60%, such as at least 65%, such as even at least 70% of the length of the hem to the waistline, but less than 99% of the length of the hem to the waistline, such as no more than 90%, such as no more than 80%, such as no more than 70%, such as no more than 60%, such as no more than 55%, such as no more than 50%, such as no more than 45%.

In one embodiment, a leg access extends from the hem to a knee access. In another embodiment, a leg access extends from the hem to a region of the leg portion that is substantially adjacent to a knee access. For example, the leg access can extend from the hem to a region of the leg portion that is less than two inches from the knee access, such as less than one and a half inches, such as less than one inch, such as even less than one-half inch from the knee access, but at least just more than zero inches from the knee access, such as at least more than one-half inch, such as at least one inch, such as at least one and a half inches. In another embodiment, a leg access extends from the hem to a region of the leg portion that is substantially separated from a knee access. For example, the leg access can extend from the hem to a region of the leg portion that is at least two inches from the knee access, such as at least two and a half inches, such as at least three inches, such as at least four inches, such as at least five inches, such as at least six inches, such as even at least seven inches from the knee access, but no more than twenty-four inches from the knee access, such as no more than eighteen inches, such as no more than twelve inches, such as no more than nine inches, such as no more than six inches, such as no more than three inches.

In one embodiment, the lower-body garment comprises one leg access along each leg portion of the lower-body garment. In another embodiment, the lower-body garment comprises more than one leg access along at least one leg portion. In another embodiment, the lower-body garment comprises one or more leg accesses along a first leg portion and no leg accesses along a second leg portion.

Figure 5:
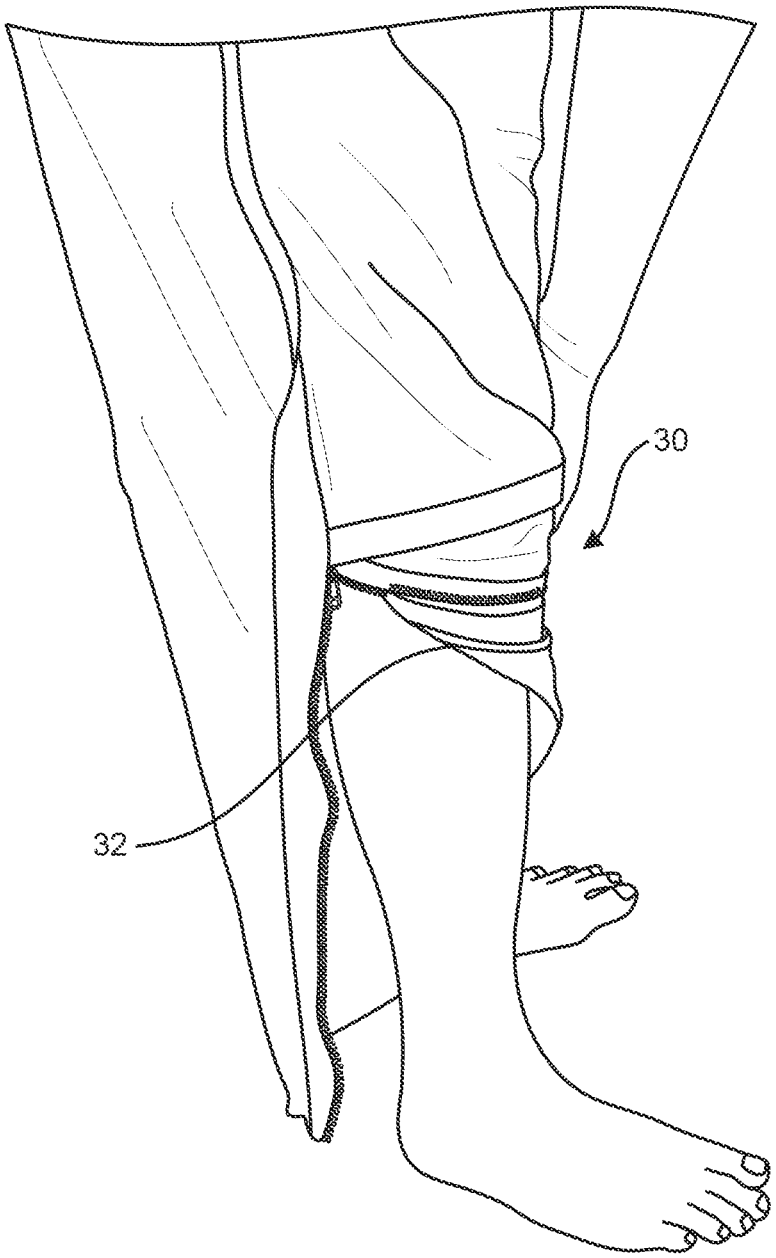
FIG. 5 is a side view of a leg access of the lower-body garment from FIG. 10A.
Figure 6:
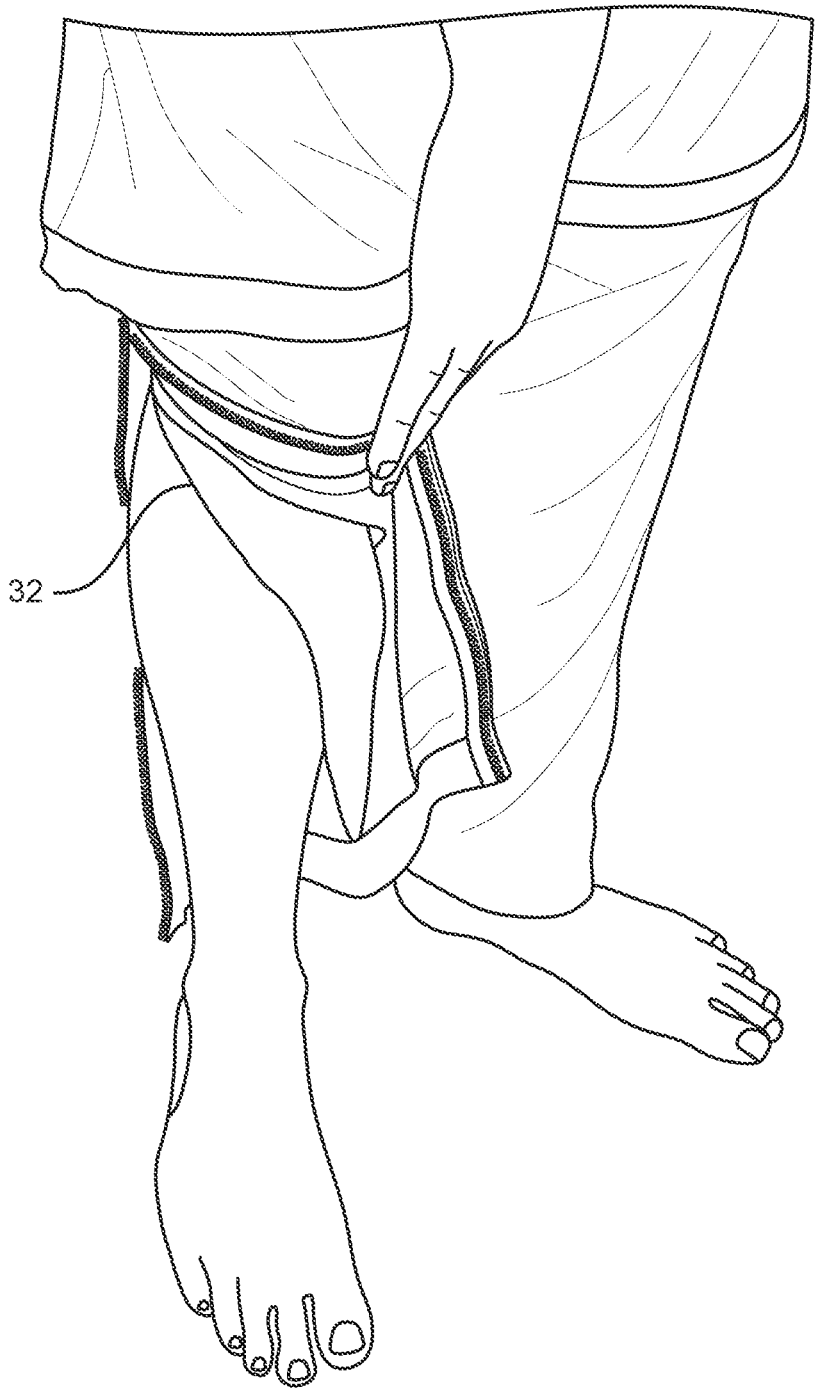
FIG. 6 is a side view of a leg access of the lower-body garment from FIG. 10A.

Pants 30 comprise first leg access 32 that extends along leg portion 42 from hem 44 to a region of leg portion 42 that is superior to hem 44. First leg access 32 can extend to a region of leg portion 42 that is superior to the wearer's knee, substantially adjacent to a knee access, and/or substantially separated from a knee access. Pants 30 are constructed and arranged with first leg access 32 in order to provide access to portions of a wearer's leg, such as the calf region as demonstrated in FIG. 5 or the shin region as demonstrated in FIG. 6. First leg access 32 can be constructed and arranged not only to provide access to the calf region as demonstrated in FIG. 5 or the shin region as demonstrated in FIG. 6, but to provide access to the entirety of a wearer's leg up into and including the hip portion. Pants 30 also comprise second leg access 33 that extends along leg portion 43 from hem 45 to a region of leg portion 43 that is superior to hem 45. Similar to first leg access 32, second leg access 33 can also extend to a region of leg portion 43 that is superior to the wearer's knee, substantially adjacent to a knee access, and/or substantially separated from a knee access. Also, second leg access 33 can be constructed and arranged in any way that first leg access 32 can be constructed and arranged.

In one embodiment, a leg access is opened or closed by an incremental fastening device. For example, the leg access can comprise a 1-way separating zipper that can separate at the hem or a 1-way open zipper that can open at the hem. For example, first leg access 32 can comprise a 1-way separating zipper that separates at hem 44 or a 1-way open zipper that opens at hem 44.

Also, the leg access can comprise, for example, a 2-way O-type zipper, a 2-way separating zipper that can separate at the hem, or a 2-way open zipper that can open at both ends of the leg access. For example, first leg access 32 can comprise a 2-way O-type zipper, a 2-way separating zipper that separates at hem 44, or a 2-way open zipper that opens both at hem 44 and the end of first leg access 32 that is distal to hem 44.

In one embodiment, the lower-body garment comprises at least one hip access. A hip access is configured along some length of the side of the lower-body garment and is constructed and arranged such that the hip access provides access to a wearer's lateral thorax, lateral abdomen, hip, pelvic area, upper leg, knee, and/or etc. without requiring the wearer to remove the lower-body garment. For example, a hip access can extend from the waistline to a region of the leg portion inferior to the waistline. Alternatively, a hip access can extend from a region of the leg portion proximal to the waistline to a region of the leg portion distal to the waistline.

The waistline located at the superior end of the lower-body garment can be comprised of more than one section. For example, the waistline may not be comprised of a single, continuous edge. In one embodiment, the waistline comprises elastic, which can be comprised of more than one continuous section of elastic. Since a hip access can terminate at the waistline, the waistline or elastic included in the waistline can be separated into more than one section by, for example, the opening of a hip access terminating at the waistline of the lower-body garment.

In one embodiment, a hip access extends from the waistline to the hem.

In one embodiment, a hip access extends from the waistline to a region of the leg portion that is, when the lower-body garment is worn by a wearer, superior to the wearer's knee. For example, the leg access can extend from the waistline to a region of the leg portion that is inferior to the waistline but distanced from the waistline by less than 60% of the length of the hem to the waistline, such as less than 55%, such as less than 50%, such as less than 45%, such as less than 40%, such as less than 35%, such as even less than 30% of the length of the hem to the waistline, but at least more than 1% of the length of the hem to the waistline, such as at least more than 10%, such as at least more than 20%, such as at least more than 30%, such as at least more than 40%, such as at least more than 45%, such as at least more than 50%, such as at least more than 55%.

In one embodiment, a hip access extends from the waistline to a knee access. In another embodiment, a hip access extends from the waistline to a region of the leg portion that is substantially adjacent to a knee access. For example, the hip access can extend from the waistline to a region of the leg portion that is less than two inches from the knee access, such as less than one and a half inches, such as less than one inch, such as even less than one-half inch from the knee access, but at least just more than zero inches from the knee access, such as at least more than one-half inch, such as at least more than one inch, such as at least more than one and a half inches. In another embodiment, a hip access extends from the waistline to a region of the leg portion that is substantially separated from the knee access. For example, the leg access can extend from the waistline to a region of the leg portion that is at least two inches from the knee access, such as at least two and a half inches, such as at least three inches, such as at least four inches, such as at least five inches, such as at least six inches, such as even at least seven inches from the knee access, but no more than twenty-four inches from the knee access, such as no more than eighteen inches, such as no more than twelve inches, such as no more than nine inches, such as no more than six inches, such as no more than three inches.

In one embodiment, the lower-body garment comprises one hip access along each side of the lower-body garment. In another embodiment, the lower-body garment comprises more than one hip access along a single side of the lower-body garment. In another embodiment, the lower-body garment comprises one or more hip accesses along a first side of the lower-body garment and no hip accesses along a second side of the lower-body garment.

Figure 8:
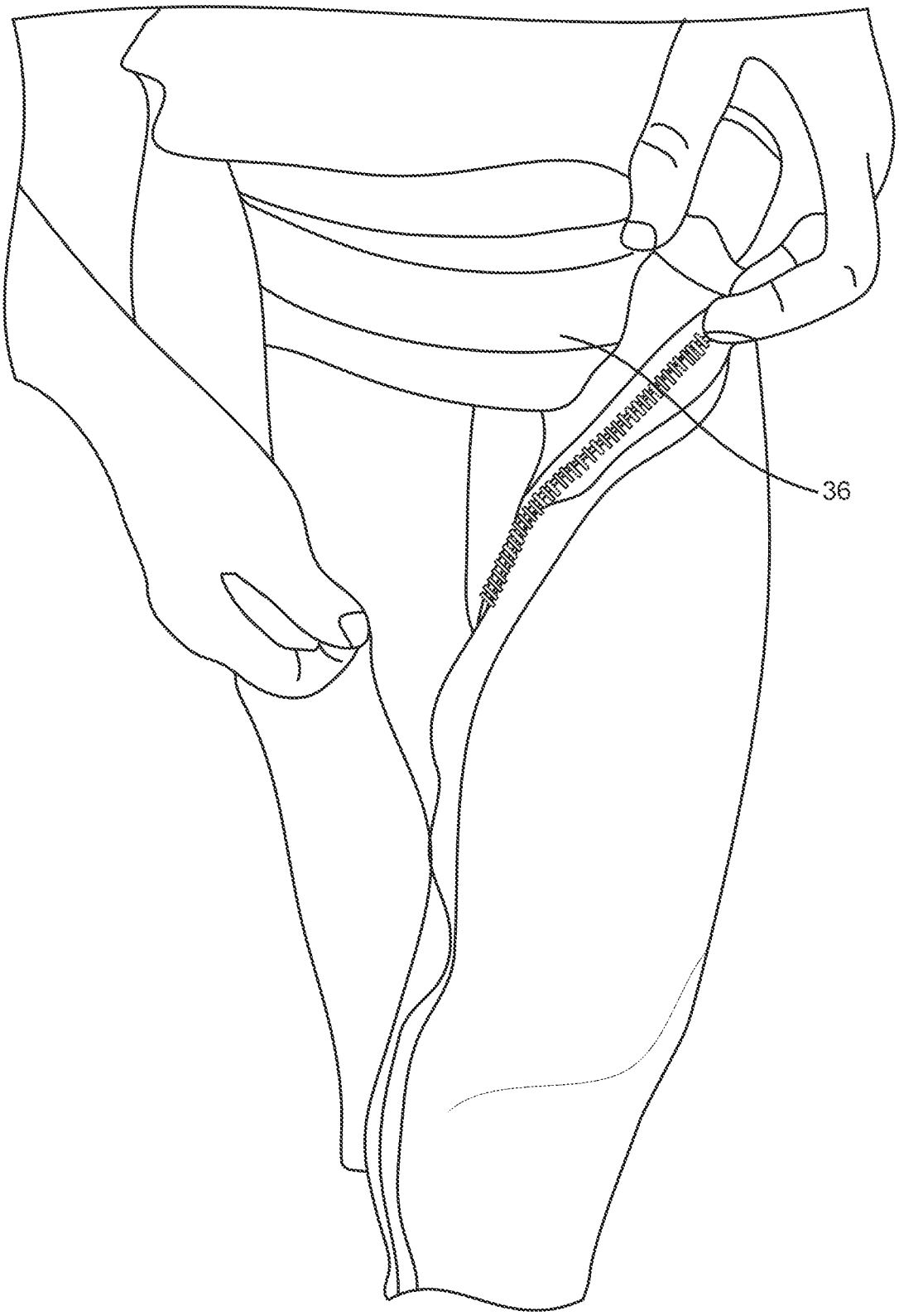
FIG. 8 is a close-up perspective view of a hip access of the lower-body garment from FIG. 10A.

Pants 30 comprise first hip access 36 that extends along the side of pants 30 from waistline 40 to a region of leg portion 42 that is inferior to waistline 40. First hip access 36 can extend to a region of leg portion 42 that is superior to the wearer's knee, substantially adjacent to a knee access, and/or substantially separated from a knee access. As shown in FIG. 8, pants 30 are constructed and arranged with first hip access 36 in order to provide access to the hip and upper leg region of a wearer's body. Pants 30 can also be constructed and arranged with first hip access 36 such as to provide access to other portions of a wearer's body, such as to the entirety of the leg down into and including the ankle and foot portion. Pants 30 also comprise second hip access 37 that extends along the other side of pants 30 from waistline 40 to a region of leg portion 43 that is inferior to waistline 40. Similar to first hip access 36, second hip access 37 can also extend to a region of leg portion 43 that is superior to the wearer's knee, substantially adjacent to a knee access, and/or substantially separated from a knee access. Also, second hip access 37 can be constructed and arranged in any way that first hip access 36 can be constructed and arranged.

The waistline 40 of pants 30 is separated into at least two sections since first hip access 36 and second hip access 37 both terminate at waistline 40. The waistline 40 of pants 30 can comprise elastic, which would also be separated into at least two sections since first hip access 36 and second hip access 37 both terminate at waistline 40.

In one embodiment, a hip access is opened or closed by an incremental fastening device. For example, the hip access can comprise a 1-way separating zipper that separates at the waistline, a 1-way separating zipper that separates at a region of the leg portion substantially adjacent to a knee access, a 1-way open zipper that opens at the end of the hip access closest to the waistline, or a 1-way open zipper that opens at the end of the hip access furthest from the waistline. For example, first hip access 36 can comprise a 1-way separating zipper that separates at waistline 40, a 1-way separating zipper that separates at a region of leg portion 42 that is substantially adjacent to first knee access 34, a 1-way open zipper that opens at the end of first hip access 36 that is closest to waistline 40, or a 1-way open zipper that opens at the end of first hip access 36 that is furthest from waistline 40.

Also, the hip access can comprise, for example, a 2-way O-type zipper, a 2-way separating zipper that separates at the waistline, a 2-way separating zipper that separates at a region of the leg portion substantially adjacent to a knee access, or a 2-way open zipper that opens at both ends of the hip access. For example, first hip access 36 can comprise a 2-way O-type zipper, a 2-way separating zipper that separates at waistline 40, a 2-way separating zipper that separates at a region of leg portion 42 that is substantially adjacent to first knee access 34, or a 2-way open zipper that opens at both ends of first hip access 36.

In one embodiment, the lower-body garment comprises at least one knee access. A knee access is configured radially about a leg portion of the lower-body garment and is constructed and arranged such that the knee access provides access to a wearer's knee, lower leg, upper leg, and/or etc. without requiring the wearer to remove the lower-body garment. For example, a knee access can extend completely around a leg portion of the lower-body garment. Alternatively, a knee access can extend only partially around a leg portion of the lower-body garment.

In one embodiment, a leg portion of the lower-body garment comprises either no knee access or a knee access that extends only partially around the leg portion. In such an embodiment, a leg access and hip access can together comprise a single access that extends from the waistline or a region proximal to the waistline to the hem of the leg portion or a region proximal to the hem of the leg portion. In one embodiment, this single access is opened or closed by an incremental fastening device. For example, this single access can comprise a 1-way separating zipper that separates at the waistline, a 1-way separating zipper than separates at the hem, a 1-way open zipper that opens at the waistline, or a 1-way open zipper that opens at the hem. Also, this single access can comprise, for example, a 2-way O-type zipper, a 2-way separating zipper that separates at the waistline, a 2-way separating zipper that separates at the hem, or a 2-way open zipper that opens at both ends of the single access.

In one embodiment, a knee access is located around a region of the leg portion that is, when the lower-body garment is worn by a wearer, superior to the wearer's knee. For example, the knee access can be located along the leg portion at a region of the leg portion that is superior to the hem and distanced from the hem by at least 40% of the length from the hem to the waistline, such as at least 45%, such as at least 50%, such as at least 55%, such as at least 60%, such as at least 65%, such as even at least 70% of the length of the hem to the waistline, but less than 99% of the length of the hem to the waistline, such as no more than 90%, such as no more than 80%, such as no more than 70%, such as no more than 60%, such as no more than 55%, such as no more than 50%, such as no more than 45%.

In one embodiment, the lower-body garment comprises one knee access radially about each leg portion of the lower-body garment. In another embodiment, the lower-body garment comprises more than one knee access radially about at least one leg portion of the lower-body garment. In another embodiment, the lower-body garment comprises one or more knee accesses along a first leg portion of the lower-body garment and no knee access along a second leg portion of the lower-body garment.

Figure 7:
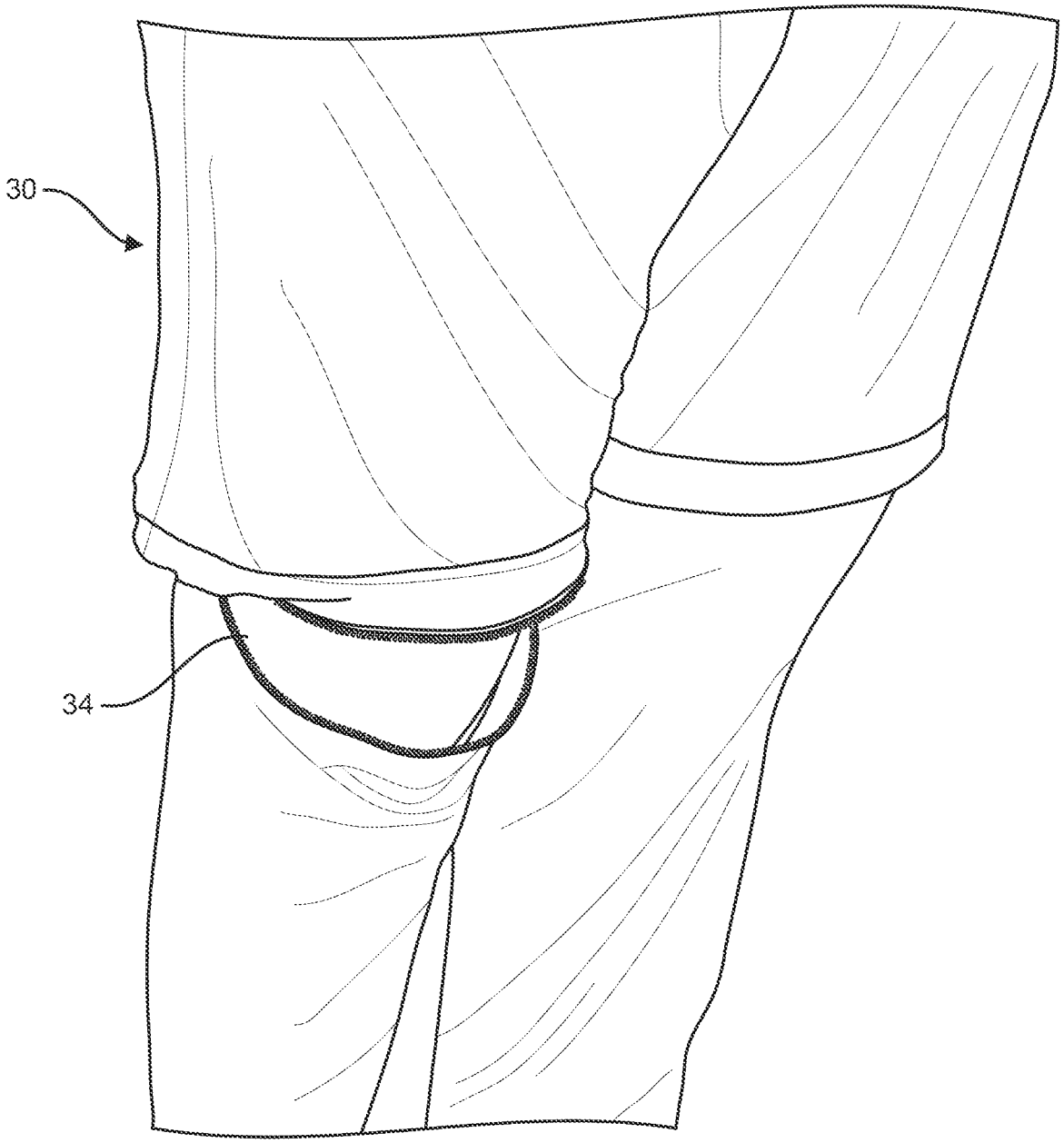
FIG. 7 is a close-up perspective view of a knee access of the lower-body garment from FIG. 10A.

Pants 30 comprise first knee access 34 that extends radially about leg portion 42. First knee access 34 can extend completely or only partially around leg portion 42 and can be located at, superior to, or inferior to a wearer's knee. As shown in FIG. 7, pants 30 are constructed and arranged with first knee access 34 in order to provide access to the knee region of a wearer's body. Pants 30 can also be constructed and arranged with first knee access 34 such as to provide access to other portions of a wearer's body, such as to the upper leg portion or lower leg portion of a wearer's body.

Pants 30 also comprise second knee access 35 that extends radially about leg portion 43. Similar to first knee access 34, second knee access 35 can extend completely or only partially around leg portion 43 and can be located at, superior to, or inferior to a wearer's knee.

In one embodiment, a knee access is opened or closed by an incremental fastening device. For example, the knee access can comprise a 1-way separating zipper or a 1-way open zipper. For example, first knee access 34 can comprise a 1-way separating zipper or a 1-way open zipper.

Also, the knee access can comprise, for example, a 2-way O-type zipper, a 2-way separating zipper, or a 2-way open zipper. For example, first knee access 34 can comprise a 2-way O-type zipper, a 2-way separating zipper, or a 2-way open zipper.

In one embodiment, a knee access extends completely around a leg portion of the lower-body garment and is constructed and arranged such that the knee access allows for an inferior portion of said leg portion to be completely detached from a superior portion of said leg portion. In this embodiment, said knee access can comprise, for example, a 1-way separating zipper or a 2-way separating zipper. For example, first knee access 34 can extend completely around leg portion 42 and can comprise a 1-way separating zipper or a 2-way separating zipper, such that first knee access 34 allows for the portion of leg portion 42 that is inferior to first knee access 34 to be completely detached from the portion of leg portion 42 that is superior to first knee access 34.

In some embodiments, the accesses are located along the seams of the article of clothing.

It is contemplated that access configurations of the present invention are constructed and arranged so as to not be readily noticeable by an observer. For example, in one embodiment, at least one access of the present invention is concealed. In these configurations, clothing configured according to the present invention appears to be like any other conventional article of clothing. The configurations in which the access openings are not readily noticeable are achieved by clothing design configurations as are known in the art. For example, it is known how to configure clothing such that a zipper is not readily noticeable. It is contemplated that such clothing design techniques are incorporated into the present invention.

In one embodiment, the article of clothing is comprised of a knit fabric. In one embodiment, the article of clothing is comprised of a fabric composed of at least 50% polyester, such as at least 60% polyester, such as at least 70% polyester, such as at least 80% polyester, such as at least 90% polyester, such as at least 95% polyester, such as even at least 100% polyester. In one embodiment, the article of clothing is comprised of anti-microbial fabric. In one embodiment, the article is comprised of a wicking fabric.

In one embodiment, the article of clothing is comprised of fabric that, in one direction or at least two directions, stretches at least 3%, such as at least 5%, such as at least 10%, such as at least 15%, but generally not more than 500%, such as not more than 300%, such as not more than 200%, as measured by ASTM D2594 "Standard Test Method for Stretch Properties of Knitted Fabrics Having Low Power."

While the invention has been described with some degree of particularity, it is understood that this description has been given only by way of example and that numerous changes in the details of construction, fabrication, and use, including the combination and arrangement of parts, may be made without departing from the spirit and scope of the invention.

What is claimed is:

1. A method for examining a patient comprising:

examining a particular area on an upper body part of a patient while allowing the patient to maintain a sense of dignity, the patient wearing an upper-body article of clothing that includes a plurality of access ports, the upper-body article of clothing comprising:

a collar;

a first sleeve and a second sleeve;

a torso portion comprising a front, a back, and two sides, wherein a superior end of the torso portion is proximal to the collar and the first and second sleeves, and wherein a hem is at an inferior edge of the upper-body article;

a first arm access extending to the collar from an edge of the first sleeve, the first arm access opening distal to the collar; and a first side torso access extending along a side of the torso portion from the hem to a region of the torso portion superior to the hem and a second side torso access extending along an opposite side of the torso portion from the hem to a region of the torso portion superior to the hem, wherein the first side torso access terminates at the hem such that the hem comprises more than one section, and wherein at least one of the access openings on the upper-body article of clothing is openable by a health-care provider in order to examine the particular area on the upper body of a patient without the patient having to remove the upper-body article of clothing.

2. A method as defined in claim 1, wherein the upper-body article of clothing is made from a knit fabric containing polyester.

3. A method as defined in claim 1, wherein at least a portion of the upper-body article of clothing comprises a fabric having a stretch in one direction of at least 5% when tested according to ASTM Test D2594.

4. The method as defined in claim 1, wherein each access is opened or closed by an incremental fastening device.

5. The method as defined in claim 1, wherein the first arm access comprises a 2-way separating zipper.

6. The method as defined in claim 1, wherein the first or second side torso access comprises a 2-way open zipper.

7. The method as defined in claim 1, wherein the first arm access comprises a 2-way separating zipper and the side torso access comprises a 2-way open zipper.

8. The method as defined in claim 1, wherein the upper-body article of clothing comprises antimicrobial fabric.

9. The method as defined in claim 1, wherein the upper-body article of clothing comprises knit fabric composed of at least 90% polyester.

10. An article of clothing that provides access to the upper body of a patient during examination of a particular area on an upper body part of a patient while allowing the patient to maintain a sense of dignity, the article of clothing comprising:

an upper-body article of clothing that includes a plurality of access ports, the upper-body article of clothing comprising:

a collar;

a first sleeve and a second sleeve;

a torso portion comprising a front, a back, and two sides, wherein a superior end of the torso portion is proximal to the collar and the first and second sleeves, and wherein a hem is at an inferior edge of the upper-body article;

a first arm access extending to the collar from an edge of the first sleeve, the first arm access opening distal to the collar; and a first side torso access extending along a side of the torso portion from the hem to a region of the torso portion superior to the hem and a second side torso access extending along an opposite side of the torso portion from the hem to a region of the torso portion superior to the hem, wherein the first side torso access terminates at the hem such that the hem comprises more than one section, and wherein at least one of the access openings on the upper-body article of clothing is openable by a healthcare provider in order to examine the particular area on the upper body of a patient without the patient having to remove the upper-body article of clothing.

* * * * *